United States Patent [19]

Crow et al.

[11] Patent Number: 4,978,819

[45] Date of Patent: Dec. 18, 1990

[54] ELECTRIC MACHINERY SWITCH ASSEMBLY

[75] Inventors: William D. Crow, Maryland Heights; Ronald D. Williams, St. Charles, both of Mo.

[73] Assignee: Emerson Electric Co., St. Louis, Mo.

[21] Appl. No.: 383,425

[22] Filed: Jul. 24, 1989

[51] Int. Cl.[5] ..... H01H 35/10

[52] U.S. Cl. ..... 200/80 R; 310/68 E

[58] Field of Search ..... 200/240, 241, 242, 246, 200/283, 80 R; 310/68 E; 307/120; 318/462, 785, 793; 73/535, 538, 540, 549, 550

[56] References Cited

U.S. PATENT DOCUMENTS

| | | | |
|---|---|---|---|
| 3,955,112 | 5/1976 | Sell | 310/68 E |
| 4,034,173 | 7/1977 | Crow | 200/80 R |
| 4,289,988 | 9/1981 | Schaefer | 310/68 E |
| 4,395,668 | 7/1983 | Kamatsu | 310/68 E |
| 4,419,550 | 12/1983 | Monette | 200/80 R |
| 4,670,631 | 6/1987 | Peachee | 200/80 R |
| 4,686,401 | 8/1987 | Gehrt | 200/80 R |

*Primary Examiner*—Gerald P. Tolin

*Attorney, Agent, or Firm*—Polster, Polster and Lucchesi

[57] ABSTRACT

A switch assembly for selectively engaging and disengaging contacts connected to electrical machinery such as the windings for an electric motor including a pair of conductive members having insulated base portions and flexible cantilevered portions extending outwardly therefrom, each carrying one of a pair of spaced opposed electrical contacts, with one cantilevered portion of the conductive members being shorter and stiffer than the other to enhance rolling wipe-action of the pair of contacts when engaged.

13 Claims, 2 Drawing Sheets

ELECTRIC MACHINERY SWITCH ASSEMBLY

BACKGROUND OF THE INVENTION

The invention relates to switch assembly structure for electrical machinery, and more particularly, to an improved conductive structure for a switch assembly which can be utilized in one or more of several forms in conjunction with switch actuators for energizing several parts of electrical machinery, such as centrifugal actuators for energizing windings of dynamoelectric machines.

U.S. Pat. No. 4,034,173, issued to William D. Crow on July 5, 1977, and U.S. Pat. No. 4,670,631, issued to C. Theodore Peachee, et al. on June 2, 1987 disclose an electric start motor which utilizes at least two windings for "start" and "run" operation. These motors include stator and rotor assemblies, the rotor assembly including a shaft and the stator assembly including a plurality of windings. As is known in the art, selective energization of windings is used to generate suitable forces for rotating the rotor assembly in both "start" and "run" conditions. For example, a rotating field may be established in a single-phase motor through an auxiliary or starting winding having current out of phase with the current in the main winding. The starting winding has a higher resistance than the main or running winding and, to eliminate losses due to the extra resistance, the starting winding is disconnected through a centrifugal actuator after the rotor has attained a desired speed, so as to continue operation by single-phase action alone.

It has been recognized as desirable that switch assemblies utilized for such purposes be low in overall construction, assembly and maintenance costs, provide appropriate contact pressure independent of switch arm position, provide for lost motion adjustment, be readily mountable, minimize contact wear and breakage and reduce construction, maintenance, operation and replacement costs. The modified switch assembly of the present invention recognizes and accomplishes these desired features, providing a switch assembly structure which requires a minimum of contact pressure, avoids undesirable variations in contact force by utilization of flat, flexible conductive members arranged in relative shape, size, thickness and geometry to provide a uniformly balanced switch assembly with a maximum of rolling wipe-action contact to reduce contact wear and breakage. In addition, the switch assembly of the present invention effectively utilizes switch arm action to ensure positive and continued electrical contact maintenance, readily accommodating for conventional machinery impact, vibration, contact adjustment and effective insulation spacing.

Various other features of the present invention will become obvious to one skilled in the art upon reading the disclosure set forth herein.

SUMMARY OF THE INVENTION

More particularly, the present invention provides a switch assembly including a terminal board for connecting a power source to the switch assembly comprising: a first electrical contact means mounted to the terminal board; a first conductive means mounted to the terminal board including a base portion and a first flexible conductive body portion extending outwardly from the base portion in cantilevered fashion and spaced from the terminal board, the body portion including a second electrical contact means positioned in spaced opposed relation to the first electrical contact means to provide a first contact pair; a second conductive means mounted to the board in insulated fashion from the first conductive means including a second base portion and a second flexible conductive body portion extending outwardly from the second base portion in cantilevered fashion and spaced from the terminal board, the second conductive body portion of the second conductive means including a third electrical contact means positioned in spaced insulated relation from the first electrical contact means; a fourth electrical contact means cooperatively positioned in spaced opposed relation to the third electrical contact means and electrically connected with the outwardly extending first flexible cantilevered conductive body of the first conductive means, the opposed third and fourth electrical contact means providing a second electrical contact pair; a switch arm mounted for movement between at least a first position and second position with respect to the terminal board to actuate the contact pairs; first switch arm actuating means to urge the switch arm to hold one of the electrical contact pairs in electrical engagement; and, second switch arm actuating means to alternatively urge the engaged contact pairs out of such electrical engagement and to hold the other contact pair in electrical engagement. In addition, the present invention provides a novel relative sizing of certain cooperating cantilevered body portions of cooperating conductive means including a stiffener arrangement for one of such cooperating cantilevered body portions. Further, the present invention provides a novel insulating block arrangement to insulate, fasten and space cooperating base portions of cooperating conductive means onto the terminal board. In addition, the present invention provides a novel, one piece, mirror-image relation for the bases and spaced cantilevered body portions of two conductive means, such arrangement further including mirror-image spaced dog-leg extremities for the cantilevered spaced body portions engaging a single actuating arm.

It is to be understood that various changes can be made by one skilled in the art in the shape, construction and operation of one or more of the several parts of the switch assembly disclosed herein without departing from the scope or spirit of the present invention. For example, it would be possible in certain instances to position the contact pairs for alternative electrical engagement along the same side of the switch actuating arm.

BRIEF DESCRIPTION OF THE DRAWINGS

Referring to the drawings which disclose one advantageous embodiment of the present invention.

DETAILED DESCRIPTION OF THE DRAWINGS

Figure 1:
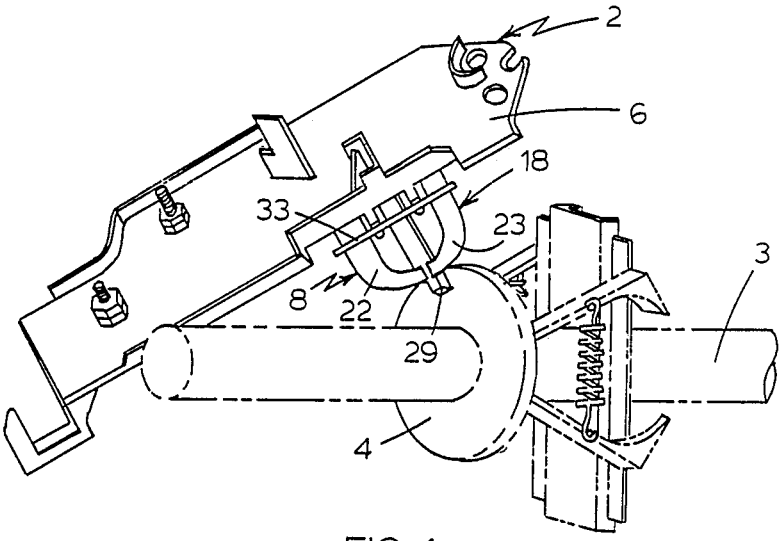
FIG. 1 is a perspective view, illustrating the inventive switch assembly positioned on the shaft of a typical motor with "start" and "run" windings and with a conventional centrifugal actuator mounted on the rotor shaft in engagement with the switch arm of the switch assembly.

Referring to FIG. 1 of the drawings, the inventive switch assembly, broadly indicated by reference numeral 2, is shown in its application with electric motor shaft 3 (shown in phantom) connected to a rotor driven by capacitor "start" and capacitor "run" windings of a dynamoelectric machine (not shown), which can be of a type to include both two-speed "start" windings for starting purposes and "run" windings for regular running purposes. A centrifugal actuator 4, which can be any one of several known types in the art, is shown as mounted on shaft 3 to engage the switch arm described hereinafter to actuate appropriate windings.

Referring to FIGS. 1–4 of the drawings, a terminal board 6, which can be formed from a suitable plastic material, is disclosed in different views. The terminal board 6 is sized and adapted to be mounted within an electric motor chamber, details of such mounting not being disclosed.

The electrical circuitry, including quick connect terminals also are not described in detail herein, it being sufficient to note the terminal board 6 connections as shown can be utilized to connect to the capacitor "start" and capacitor "run" windings with switch assembly 2 being connected across the main power line along with the "start" and "running" windings. In the embodiment disclosed, the "start" windings are spring urged into normally closed position to energize the "start" windings. Through centrifugal actuator 4, the switch arm of switch assembly 2 is moved from a first to a second position to alternatively deenergize the "start" windings and energize the "run" windings.

Figure 2:
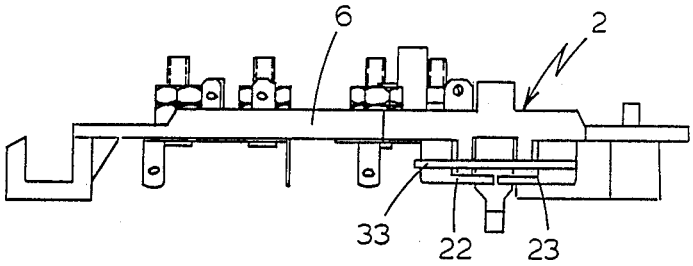
FIG. 2 is a front end view of the switch assembly of FIG. 1.
Figure 3:
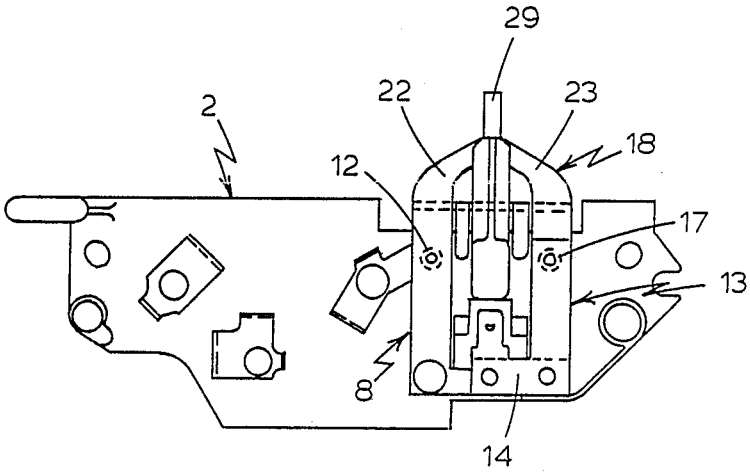
FIG. 3 is a bottom view of the switch assembly of FIGS. 1 and 2; and, FIG. 4 is an exploded perspective view of the switch assembly of FIGS. 1–3.
Figure 4:
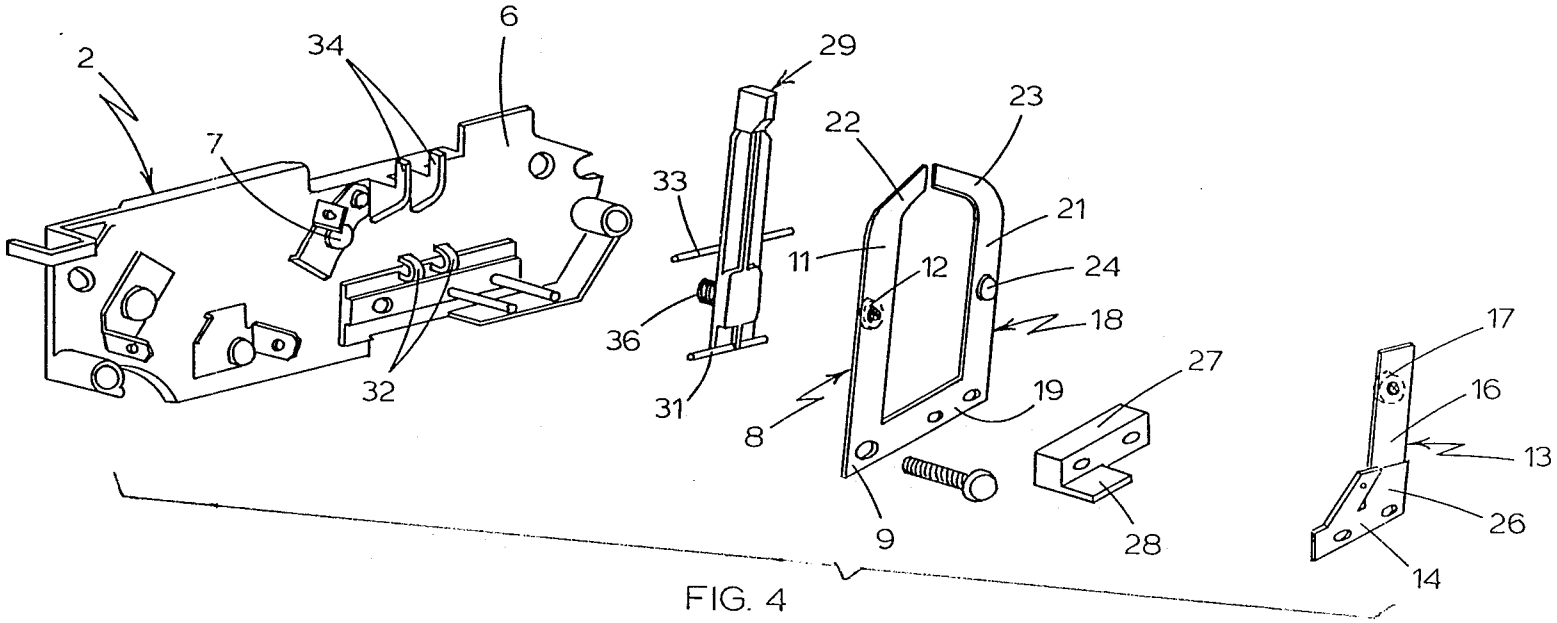

As can be seen in FIGS. 2–4 of the drawings, and particularly the exploded view of FIG. 4, terminal board 6 has a first electrical contact 7 mounted flatly thereto by a suitable screw and nut fastening assembly. A first conductive means 8 is mounted at one end thereof to terminal board 6, also by a suitable screw and nut assembly fastening the same to board 6 in spaced, insulated relation from contact 7. This first conductive means includes a base portion 9 and a first flat flexible body portion 11. Body portion 11 extends outwardly from base portion 9 in cantilevered fashion above terminal board 6 and has fastened thereto a second electrical contact 12 (shown in dotted line form in FIG. 4) which is positioned in spaced opposed relation to the first contact 7, to form a first contact electrical pair 7, 12 which is normally opened and in the embodiment discussed is connected to the "run" winding.

A second conductive means 13 is mounted to terminal board 6 in laterally spaced insulated fashion from and above the first conductive means 8. This second conductive means 13 includes a second base portion 14 and a second flexible conductive body portion 16 extending outwardly from the second base portion 14 to include a third electrical contact 17 spaced from and above the first contact 7 (also shown in dotted line form in FIG. 4).

A third conductive means 18 is mounted to the terminal board 6 and includes a third base portion 19 which is fastened to board 6 and a third flexible conductive body portion 21 extending outwardly from such base portion 19 in cantilevered fashion and in spaced parallel relation to the first body portion 11. In this regard and as can be seen clearly in FIG. 4, the spaced parallel body portions 11 and 21 and their base portions 9 and 19 can be formed from one flat piece of electrically conductive material, such as a flat copper strip of preselected width. The base portions 9 and 19 constitute a solid strip of material and the spaced parallel body portions 11 and 21 being of mirror-image flat curvilinear surfaces having extreme arm portions 22, 23 respectively, which extend beyond and laterally offset inwardly with respect to body portions 11 and 21 to provide a pair of mirror-image, insulatively spaced dog-leg portions 22 and 23, respectively. Thus, a one-piece flat horseshoe shape is provided for both the first and third conductive means 8, 18, respectively and includes joined base portions 9 and 19, and spaced parallel cantilevered conductive body portions 11 and 21, with insulatively spaced inturned dog-leg portions 22 and 23, respectively.

The body portion 21 of the one-piece horseshoe arrangement includes a fourth electrical contact 24 thereon, positioned in spaced opposed relation to third contact 17 on second cantilevered conductive body portion 16, to provide a second contact pair 17, 24 which can be associated with the "start" windings of an electric motor, as above described. In this regard, it is to be noted that this second cantilevered conductive body portion 16 is shorter than the mirror-image spaced first and third cantilevered conductive body portions 11 and 21. Body portion 16 has also mounted in fastened relation thereon, to extend coextensive with base portion 19 and a limited part of second body portion 16, a stiffener strip 26. With relatively shortened body portion 16, with stiffener second contact strip 26, and with the contacts of each pair 17, 24 being shaped and movable relative to each other to provide a rolling wipe-action contact, the rolling wipe-action is further enhanced and at the same time the pressure engagement between the contacts of second contact pair 17, 24 is controlled to provide optimum engagement with minimum contact wear. Further, the unified horseshoe shaped mirror-image construction of the above described first and third conductive means 8 and 18, including the spaced parallel cantilevered body portions 11 and 21, provides an enhanced switch assembly balance.

To insulate the base portion 19 of the third conductive means 18 from the base portion 14 of the second conductive means 13, an insulating spacer block 27 is mounted to terminal board 6, to coextend between such base portions 14 and 19. Thus, the second conductive means 13 and third conductive means 18 are fastened to terminal board 6 in spaced, aligned relation along with their contacts 17 and 24, the in spaced opposed relation to one another, to form second contact pair 17, 24. It is to be noted that insulating spacer block 27 is provided with an insulating riser wall 28 which extends normally from the back edge thereof to further insulate the second conductive means 13.

In order to actuate the aforedescribed contact pairs 7, 12 and 17, 24, a switch arm 29, advantageously formed from insulated plastic material similar to terminal board 6, is pivotally mounted on terminal board 6 intermediate the spaced, parallel cantilevered body portions 11 and 21 of first conductive means 8 and the third conductive means 18. A cross bar 31, at one extremity of switch arm 29, engages the spaced pair of lower hooks 32 extending from a first location on terminal board 6. A second cross bar 33 on switch arm 29 is spaced a preselected distance from cross bar 31 that is pivoted in lower hooks 32 and is arranged to engage with a similarly spaced pair of higher hooks 34 also extending from terminal board 6.

The interengagement between the cross bar 33 of arm 29 and the higher hooks on terminal board 6 limits the pivotal movement of switch arm 29, which is normally urged outwardly from terminal board 6 by a resilient coil spring 36 interposed between the switch arm 29 and terminal board 6.

It is to be noted that spaced cantilevered body portions 11 and 21, with their respective contacts 12 and 24, rest on cross bar 33, with associated dog-leg portions 22 and 23 abutting the free, cantilevered extremity of switch arm 29. Switch arm 29, is resiliently biased by coil spring 36 to urge and maintain contact 24 into wipe action normally closed engagement with opposed contact 17. This normally closed, engaged second contact pair 17, 24 serves to energize the "start" windings of the motor which are associated with this second contact pair 17, 24. When the motor reaches a preselected speed, the afore-described centrifugal actuator 4 on motor shaft 3 (FIG. 1) moves against switch arm 29, depressing resiliently biasing coil spring 36 so as to disengage contact pair 17, 24 associated with the "start" winding and causing the normally open first contact pair 7, 12, associated with the "run" windings, to close, energizing such "run" windings.

Because the free cantilevered extremity of arm 29 engages the dog-leg portions 22 and 23 associated with spaced cantilevered body portions 11 and 21, the depression of the switch arm 29 and its coil spring 36, by centrifugal actuator 4, enables the normally open first contact pair 7 and 12 to be closed to engage the "run" winding. The first contact pair 7 and 12 are closed since body portion 11 and its associated contact 12 are, at that time, positioned in normal abutting engagement with the first contact 7. At the same time, the cantilevered body portion 21, which is normally spaced by the insulated space block 27 from body portion 16, is allowed to move away from its spring urged contact position to its normal position spaced from body portion 16, thus allowing the second contact pair 17 and 24 to be disengaged, for disconnecting the "start" winding. Engagement of the dog-leg portions 22 and 23 associated with the spaced cantilevered body portions 11 and 21, by the free cantilevered extremity of arm 29, serves to provide a maximum of rolling wipe-action contact so as to reduce contact wear and breakage.

From the above, it can readily be seen that a novel, straightforward and economical switch assembly is provided which is balanced, which allows for controlled switch pressure and which provides for a maximum of rolling wipe-action to reduce contact wear and breakage. At the same time undesirable variations in contact force are avoided regardless of the conventional impact forces and vibrations to which such an assembly might be exposed.

The invention claimed is:

1. A switch assembly including a terminal board for connecting a power source to said switch assembly, comprising:

first electrical contact means mounted to said terminal board;

first conductive means mounted to said terminal board including a base portion and a first flexible conductive body portion extending outwardly from said base portion in cantilevered fashion, said first flexible conductive body portion including a second electrical contact means cooperatively positioned in spaced opposed relation to said first electrical contact means, said opposed first and second electrical contact means providing a first electrical contact pair;

second conductive means mounted to said board in insulated fashion from said first conductive means and including a second base portion and a second flexible conductive body portion extending outwardly from said second base portion in cantilevered fashion, said second flexible conductive body portion of said second conductive means including a third electrical contact means positioned in spaced insulated relation from said first electrical contact means;

third conductive means mounted to said board and including a third base portion and a third flexible conductive body portion extending outwardly from said third base portion in cantilevered fashion, said third flexible conductive body portion of said third conductive means including a fourth electrical contact means cooperatively positioned in spaced opposed relation to said third electrical contact means, said opposed third and fourth electrical contact means providing a second electrical contact pair;

the first flexible conductive body portion of said first conductive means and the third flexible conductive body portion of said third conductive means being electrically and physically connected to one another to provide a uniformly balanced switch assembly; and said first conductive body portion, second conductive body portion and third conductive body portion being fixedly mounted to one another on the same end through said respective first base portion, second base portion and third base portion and an insulating member provided between and contacting said second base portion and said first and third base portions a switch arm mounted to said board for movement between at least a first position and a second position to alternately actuate said first and second electrical contact pairs into and out of electrical engagement, one of said first and second electrical contact pairs being in electrical engagement, and said switch arm and said first and third flexible conductive body portions being constructed and mounted to said board for simultaneous alternate disengagement and engagement of said first and second electrical contact pairs.

2. The switch assembly as defined in claim 1 including a coil compression spring, said coil compression spring being mounted between said terminal board and said switch arm to bias one of said first and second electrical contact pairs into electrical engagement.

3. The switch assembly as defined in claim 2 wherein the first flexible conductive body portion of said first conductive means is biased in a first direction with respect to said terminal board, and the third flexible conductive body portion of said third conductive means is biased in a second direction with respect to said terminal board.

4. The switch assembly as defined in claim 3 wherein said switch arm includes a cross arm for engaging said first and third flexible conductive body portions when biased by said coil spring to move the second electrical contact means of said first flexible conductive body portion out of engagement with the first electrical contact means in said first electrical contact pair, said third flexible conductive body portion including said fourth electrical contact means being brought into engagement with the third electrical contact means of said second flexible conductive body portion by said cross arm when biased by said coil spring.

5. The switch assembly as defined in claim 1 wherein the first and third flexible conductive body portions are substantially parallel to one another and have a common base portion physically and electrically connecting said body portions to one another to define a general horseshoe shape, free end portions of said first and third flexible conductive body portions formed as laterally inwardly offset opposed and spaced dog-leg portions arranged in mirror image relationship to one another, said switch arm having a free extremity thereof which engages the opposed and spaced dog-leg portions of said first and third flexible conductive body portions to simultaneously alternately actuate said first and second electrical pairs.

6. The switch assembly as defined in claim 1 wherein the second flexible conductive body portion including the third electrical contact means of said second conductive means is shorter and stiffer than the third flexible conductive body portion including the fourth electrical contact means of said third conductive means to enhance the wiping action of the third and fourth electrical contact means comprising the second electrical contact pair.

7. The switch assembly as defined in claim 6 wherein said insulating member has an insulated riser wall to further insulate the second flexible conductive body portion mounted to said insulating member.

8. A switch assembly for controlling the "start" and "run" windings of an electric motor including a rotor shaft mounted centrifugal actuator, said switch assembly having a terminal board for connecting the "start" and "run" windings, comprising:

first electrical contact means mounted to said terminal board;

first conductive means mounted to said terminal board including a base portion and a first flexible conductive body portion extending outwardly from said base portion in cantilevered fashion, said first flexible conductive body portion including a second electrical contact means cooperatively positioned in spaced opposed relation to said first electrical contact means, said opposed first and second electrical contact means providing a first electrical contact pair;

second conductive means mounted to said board in insulated fashion from said first conductive means and including a second base portion and a second flexible conductive body portion extending outwardly from said second base portion in cantilevered fashion, said second flexible conductive body portion of said second conductive means including a third electrical contact means positioned in spaced insulated relation from said first electrical contact means;

third conductive means mounted to said board and including a third base portion and a third flexible conductive body portion extending outwardly from said third base portion in cantilevered fashion, said third flexible conductive body portion of said third conductive means including a fourth electrical contact means cooperatively positioned in spaced opposed relation to said third electrical contact means, said opposed third and fourth electrical contact means providing a second electrical contact pair;

the second flexible conductive body portion including the third electrical contact means being shorter and stiffer than the third flexible conductive body portion including the fourth electrical contact means;

the first flexible conductive body portion of said first conductive means and the third flexible conductive body portion of said third conductive means being substantially parallel to one another and having a common base portion electrically and physically connected to one another to provide a uniformly balanced switch assembly free end portions of said first and third flexible conductive body portions being formed as laterally inwardly offset opposed and spaced dog-leg portions arranged in mirror image relationship to one another;

said first conductive body portion, second conductive body portion and third conductive body portion being fixedly mounted to one another on the same end through said respective first base portion, second base portion and third base portion and an insulating member provided between and contacting said second base portion and said first and third base portions a switch arm mounted to said board and spring biased for movement between a first position and a second position to resiliently urge the second contact pair into electrical engagement, the free extremity of said switch arm being constructed to engage the opposed and spaced dog-leg portions of said first and third flexible conductive body portions for simultaneous alternate actuation of said first and second contact pairs to cause disengagement of said second contact pair and electrical engagement of said first contact pair; and switch arm actuating means including said centrifugal actuator.

9. In an electric motor having a stator assembly including a shaft, said stator assembly including a plurality of windings, the selective energization of said windings being utilized to generate a force for rotating said rotor assembly and a centrifugal actuator mounted to said shaft including at least a part mounted to said shaft, the improvement comprising: first electrical contact means mounted to a terminal board; first conductive means mounted to said terminal board including a base portion and a first flexible conductive body portion extending outwardly from said base portion in cantilevered fashion, said first flexible conductive body portion including a second electrical contact means cooperatively positioned in spaced opposed relation to said first electrical contact means, said opposed first and second electrical contact means providing a first electrical contact pair; second conductive means mounted to said board in insulated fashion from said first conductive means and including a second base portion and a second flexible conductive body portion extending outwardly from said second base portion in cantilevered fashion, said second flexible conductive body portion of said second conductive means including a third electrical contact means positioned in spaced insulated relation from said first electrical contact means; third conductive means mounted to said board and including a third base portion and a third flexible conductive body portion extending outwardly from said third base portion in cantilevered fashion, said third flexible conductive body portion of said third conductive means including a fourth electrical contact means cooperatively positioned in spaced opposed relation to said third electrical contact means, said opposed third and fourth electrical contact means providing a second electrical contact pair; the first flexible conductive body portion of said first conductive means and the third flexible conductive body portion of said third conductive means being electrically and physically connected to one another to provide a uniformly balanced switch assembly;

said first conductive body portion, second conductive body portion and third conductive body portion being fixedly mounted to one another on the same end through said respective first base portion, second base portion and third base portion and an insulating member provided between and contacting said second base portion and said first and third base portions and a switch arm mounted to said board for movement between at least a first position and a second position to alternately actuate said first and second contact pairs into and out of electrical engagement, one of said first and second contact pairs being in electrical engagement, and said switch arm and said first and third flexible conductive body portions being constructed and mounted to said board for simultaneous alternate disengagement and engagement of said first and second contact pairs.

10. The improvement as defined in claim 9 wherein the first and third flexible conductive body portions are substantially parallel to one another and have a common base portion physically and electrically connecting said body portions to one another to define a general horseshoe shape, free end portions of said first and third flexible conductive body portions formed as laterally inwardly offset opposed and spaced dog-leg portions arranged in mirror image relationship to one another, said switch arm having a free extremity thereof which engages the opposed and spaced dog-leg portions of said first and third flexible conductive body portions to simultaneously alternately actuate said first and second contact means.

11. In a switch assembly including a terminal board for connecting a source of power through said switch assembly, including first electrical contact means mounted to said terminal board, the improvement comprising:

first conductive means mounted to said terminal board and including a first base portion and a first conductive body portion extending outwardly from said first base portion, said first conductive body portion including second electrical contact means cooperatively positioned in spaced opposed relation to said first electrical contact means;

second conductive means mounted to said terminal board and including a second base portion and a second conductive body portion extending outwardly from said second base portion, said second conductive body portion including a third electrical contact means positioned in spaced insulated relation from said first electrical contact means;

third conductive means mounted to said terminal board and including a third base portion and a third conductive body portion extending outwardly from said third base portion, said third conductive body portion including a fourth electrical contact means cooperatively positioned in spaced opposed relation to said third electrical contact means;

said first conductive body portion, second conductive body portion and third conductive body portion being fixedly mounted to one another on the same end through said respective first base portion, second base portion and third base portion and insulating member provided between and said contacting second base portion and said first and third base portions; and actuator means mounted to said terminal board for movement between a first position and a second position to alternately actuate said first and second electrical contact means and said third and fourth electrical contact means into and out of electrical engagement with one another.

12. In a switch assembly including a terminal board for connecting a source of power through said switch assembly and including actuator means for operating said switch assembly, the improvement comprising:

first, second and third conductive means mounted in spaced relation to one another on said terminal board and each including a base portion and a conductive body portion extending outwardly from each said base portion;

said first conductive body portion having an electrical contact for cooperative electrical engagement with an electrical contact on said terminal board and said second and third conductive body portions also having cooperating electrical contacts;

said first, second and third conductive body portions being fixedly mounted to one another on the same end through said first, second and third base portions, and an insulating member provided between and contacting said second base portion are said first and third base portion; and said first, second and third conductive body portions being engaged by said actuator means for alternate actuation of said cooperating electrical contacts.

13. The improvement as defined in claim 12 wherein the beam length of each of said first conductive body portion, second conductive body portion and third conductive body portion being adjustable to vary the switch pressure and wiping action between the switch contacts.

* * * * *

UNITED STATES PATENT AND TRADEMARK OFFICE

CERTIFICATE OF CORRECTION

PATENT NO. : 4,978,819

DATED : December 18, 1990

INVENTOR(S) : William D. Crow et al

It is certified that error appears in the above—identified patent and that said Letters Patent is hereby corrected as shown below:

Column 4, lines 5 and 6 is "21 being of mirror-image flat curvilinear surfaces having extreme";
should be -- 21 are in mirror-image relationship including extreme --.

Signed and Sealed this

Nineteenth Day of May, 1992

*Attest:*

DOUGLAS B. COMER

*Attesting Officer*

*Acting Commissioner of Patents and Trademarks*